US006126788A

United States Patent [19]

Schiel

[11] Patent Number: 6,126,788

[45] Date of Patent: Oct. 3, 2000

[54] APPARATUS FOR DEWATERING OF PAPER MACHINE FELTS

[76] Inventor: Christian Schiel, Kandinsky Weg 8, D-82418 Murnau, Germany

[21] Appl. No.: 09/106,605

[22] Filed: Jun. 29, 1998

[30] Foreign Application Priority Data

| | | | |
|---|---|---|---|
| Jun. 30, 1997 | [DE] | Germany | 197 27 523 |
| Jun. 30, 1997 | [DE] | Germany | 297 11 280 |
| Jun. 12, 1998 | [DE] | Germany | 298 10 486 |

[51] Int. Cl.[7] ..... D21F 7/12; D21F 1/32

[52] U.S. Cl. ..... 162/278; 162/275; 162/279

[58] Field of Search ..... 162/275, 277, 162/278, 279, 358.1

[56] References Cited

U.S. PATENT DOCUMENTS

| | | | |
|---|---|---|---|
| 1,840,102 | 1/1932 | Tespersen | 162/279 |
| 2,544,572 | 3/1951 | Vickery | 162/279 |
| 2,905,241 | 9/1959 | Smith | 162/279 |
| 3,013,938 | 12/1961 | Justus et al. | 162/279 |
| 3,278,368 | 10/1966 | Wicker | 162/279 |
| 3,671,389 | 6/1972 | Wahlstrom | 162/358.1 |
| 3,859,163 | 1/1975 | Haythornwaite | 162/279 |
| 4,880,500 | 11/1989 | Eldridge et al. | 162/279 |
| 5,147,508 | 9/1992 | Sweet | 162/279 |

FOREIGN PATENT DOCUMENTS

| | | | |
|---|---|---|---|
| 229691 | 10/1963 | Nauru | 162/278 |
| 1285414 | 8/1972 | United Kingdom | 162/279 |

*Primary Examiner*—Karen M. Hastings

*Attorney, Agent, or Firm*—Ice Miller; Doreen J. Gridley; James D. Wood

[57] ABSTRACT

An apparatus for the dewatering of a traveling press felt carries a purging fluid to the inside surface of the felt loop. The purging fluid flushes water from the felt into receptacles inside the felt loop. Purging nozzles oriented in the cross machine direction, or a multitude of suction slots oriented in the running direction, may be used. The nozzles or slots are incorporated into a nozzle block that is fastened to a suction box or a blow box.

14 Claims, 6 Drawing Sheets

APPARATUS FOR DEWATERING OF PAPER MACHINE FELTS

BACKGROUND OF THE INVENTION

1. Field of the Invention

The present invention relates to an apparatus for the ejection of water from a running felt loop in a paper machine.

2. Description of the Related Art

In traditional devices, water is sucked out of the felt by the application of vacuum to one side of the felt and the purging action of a stream of air entering the other side of the felt. The water is thus conveyed into stationary suction slots or suction holes of a rotating suction roll.

According to another method, the water can be squeezed out by compressing the felt in a press nip. A so-called wringer press serving this purpose is very expensive, consumes a considerable amount of energy, and reduces the service life of the felt. For these reasons, wringer presses are rarely found in today's paper machines.

With the introduction of synthetic needle felts, through-purging with air has become the common method of felt dewatering in all cases where the water cannot be removed directly in the press nip. In this latter case, however, the press rolls must be fitted with special devices for holding the water at the nip exit, making the press rolls expensive and complex.

These rolls supporting the felt can be designed as suction rolls with a perforated rotating shell, or as grooved rolls with grooves of 2.5 to 5 mm depth and 0.5 to 1 mm width on their outer periphery. In the case that the press roll supporting the felt is a shoe press roll, no suction can be applied because the rotating flexible press sleeve must be unperforated in order to form a lubricant film on the pressing shoe.

Because of the special properties of its material, the press sleeve cannot be made very thick or hard. Therefore, only relatively shallow grooves of maximally 1.5 mm depth or blind drilled holes of 2 mm depth can be incorporated into the outer surface. This results in a limited water storage and removal capacity of these press sleeves that cannot be extended to meet the demands of many pressing applications. Therefore, some water must still be removed from the felt by air purging, demanding high permeability felts. Felts of higher permeability, however, include coarse fibers that mark or "emboss" the surface of the paper in a detrimental way and lead to an increased water reabsorption at the press nip exit back into the paper. If, on the other hand, the felt is made sufficiently fine-pored in order to produce an optimally smooth paper surface and to avoid water reabsorption, the concept of air purging will fail.

SUMMARY OF THE INVENTION

The present invention provides a system that allows the dewatering of a felt with an optimized fine surface on its paper side by simple devices to a sufficient degree. This dewatering shall happen in a linear or slightly curved stretch of the felt run, free of rolls that deflect the felt by a substantial angle.

The dewatering of the felt is effected by leading a current of purging gas against the inside surface of the felt loop. The current of purging fluid tears water loose from the inside surface or out of cavities or interstices in the carrier layer of the felt. The water is then conveyed into receptacles located inside the felt loop.

This mode of dewatering is possible in the case wherein the felt possesses good water storage and water release properties at its inside surface. A felt loop can be composed of a carrier layer that contains cavities, interstices and openings at its inner surface. To the outside of the carrier layer is a bat of fine fibers which is needled, with the bat fibers which are drawn into the cavities of the carrier layer being post-treated for reduction of free fiber surface in the cavities. The carrier layer may be a multi-layer plastic fabric.

The purging current is a flow of gas, normally air. For a satisfactory effect, it is important to direct the purging current in such a way that it removes as much water as possible at a given flow rate. This condition is brought about by a purging device that forces the total flow to pass through the base layer of the felt.

This is effected by placing one or more purging nozzles against the inside of the felt in such a way that the felt is gliding over the lips that surround the nozzles. If the purging nozzles are evacuated, ambient air is drawn over the lips through the permeable carrier layer of the felt and into the nozzles. This air tears loose and carries away water stored in the interstices and cavities of the carrier layer of the felts and makes them free for storage of additional water during the next nip passage.

Because acceleration and conveyance of water and air in the carrier layer is causing resistance to flow, it is advantageous to make the lips narrow in order to effect good drainage with a reasonably small pressure differential. Lip width, therefore, is in the range of 10 mm or less, preferably 2 mm to 10 mm and typically 5 mm.

When using purging nozzles oriented in the cross machine direction, the relative velocity of the purging fluid in the felt must be equal to or higher than the felt running speed. This leads to very high vacuum requirements in the nozzle and hence the high vacuum pump drive power. An additional negative effect is abrasion of the nozzle block and of the felts.

For the above reasons, the vacuum slots and purging nozzles are oriented totally or predominantly in the felt running direction. In this embodiment, the felt can be dewatered with a fairly small pressure differential up to the very highest machine speeds. The dewatering is most effective at an angle of inclination from 0 to 10°, preferably 0 to 5°, and more preferably between 0.5° and 2°, between the longitudinal direction of the slots and purging nozzles and the direction of felt travel.

Narrow longitudinal slots can be filled up with dirt much easier than one wide cross machine slot. Therefore, a retraction or swiveling device is advantageous that brings the gliding surface of the nozzle block into a position that facilitates the cleaning of the slots without obstruction by the felt.

According to another embodiment, special cleaning nozzles are directed into the suction slots to enable the continuous or discontinuous cleaning of the slots with pressurized water.

The cleaning of the total purging unit can be continuous, but the individual cleaning nozzle in the suction slot may spray in a sequential pattern. This behavior may be effected by arranging a multitude of cleaning water supply zones across the machine width and activating them in a sequential manner, so that only one zone at a time is active. Alternatively, an oscillating gate bar at the entrance of the nozzles can contain ports that open and close the nozzle entrances when the bar is oscillated in cross machine direction.

An oscillating internal shower pipe with fan nozzles may be useful for moistening and cooling the gliding surface of the nozzle block and for cleaning the cavities within the carrier layer. For this latter purpose, needle shower pipes are exceptionally useful.

In the press nip, the bat layer is compressed and, because of the visco-elastic behavior of the bat fibers, does not recover to its original thickness at once at the nip exit, but rather creeps slowly back during the return run in the felt loop. During this phase of bat expansion, a portion of the water expressed into the carrier layer is sucked back into the bat. It is, therefore, advantageous to place the felt purger as near as possible to the press nip exit, preferably no farther away than one quarter of the total felt length in order to maximize the purging effect.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
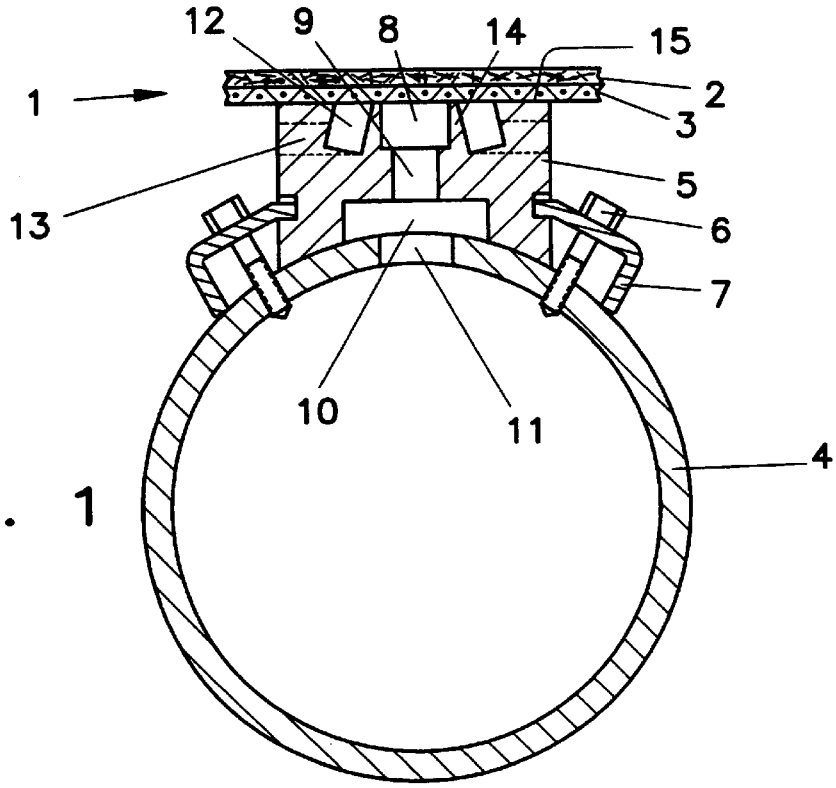
FIG. 1 is a cross-sectional view of one embodiment of a felt purger of the present invention along line I—I in FIG. 2.

Referring now to the drawings and particularly to FIG. 1, there is shown a segment of a running felt loop 1. The running direction may be from left to right or vice versa. The felt 1 is composed of a carrier layer 3, containing larger cavities and a bat layer 2 of fine fibers bonded to it. A nozzle block 5 is fixed with screws 6 and clamps 7 to a tubular suction conduit 4.

Water and purging air is drawn out of the carrier layer 3 and into conduit 4 through suction slot 8, passages 9, groove 10 and passages 11. The water and purging air is passed on through an exhaust pipe (not shown) to the suction side of a pump or blower. On both sides of the suction nozzle 8 there are air supply slots 12 connected by passages 13 to the ambient atmosphere.

Figure 2:
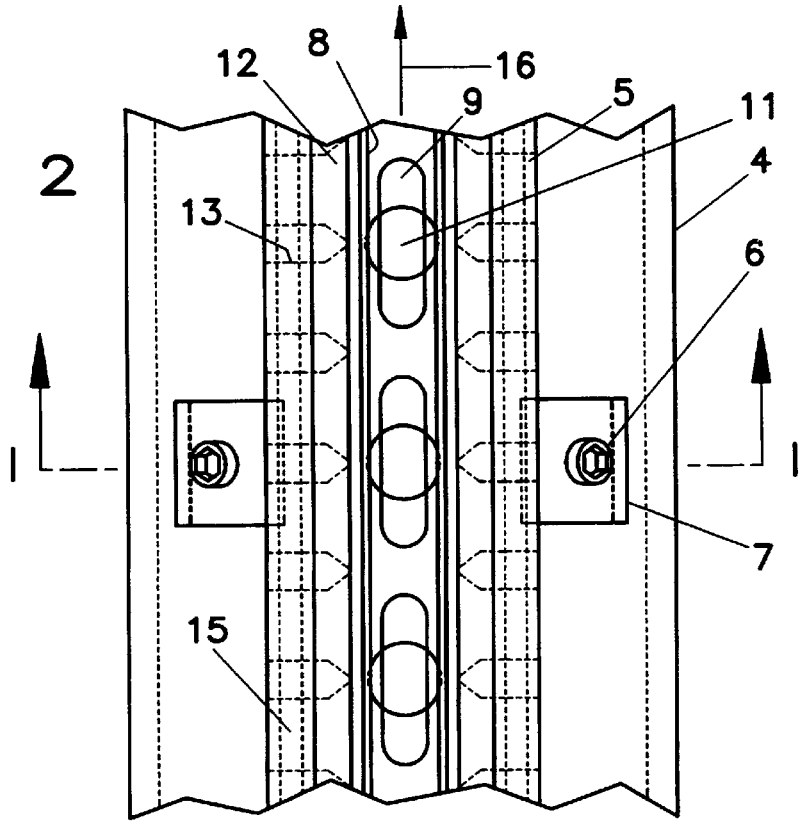
FIG. 2 is a top view of a segment of the felt purger of FIG. 1.

Because the lips 14 on both sides of suction slot 8 are too narrow to give the felt 1 sufficient support, the nozzle block 5 is made wide enough to provide additional support for the felt 1 on faces 15 outside the air supply slots 12. In FIG. 2 the components are identified with same reference numbers as in FIG. 1. Felt 1 is not shown for reasons of clarity. Evacuation of conduit 4 is effected in direction of arrow 16 to the end of the conduit 4 (not shown) where it connected into a vacuum line.

Figure 3:
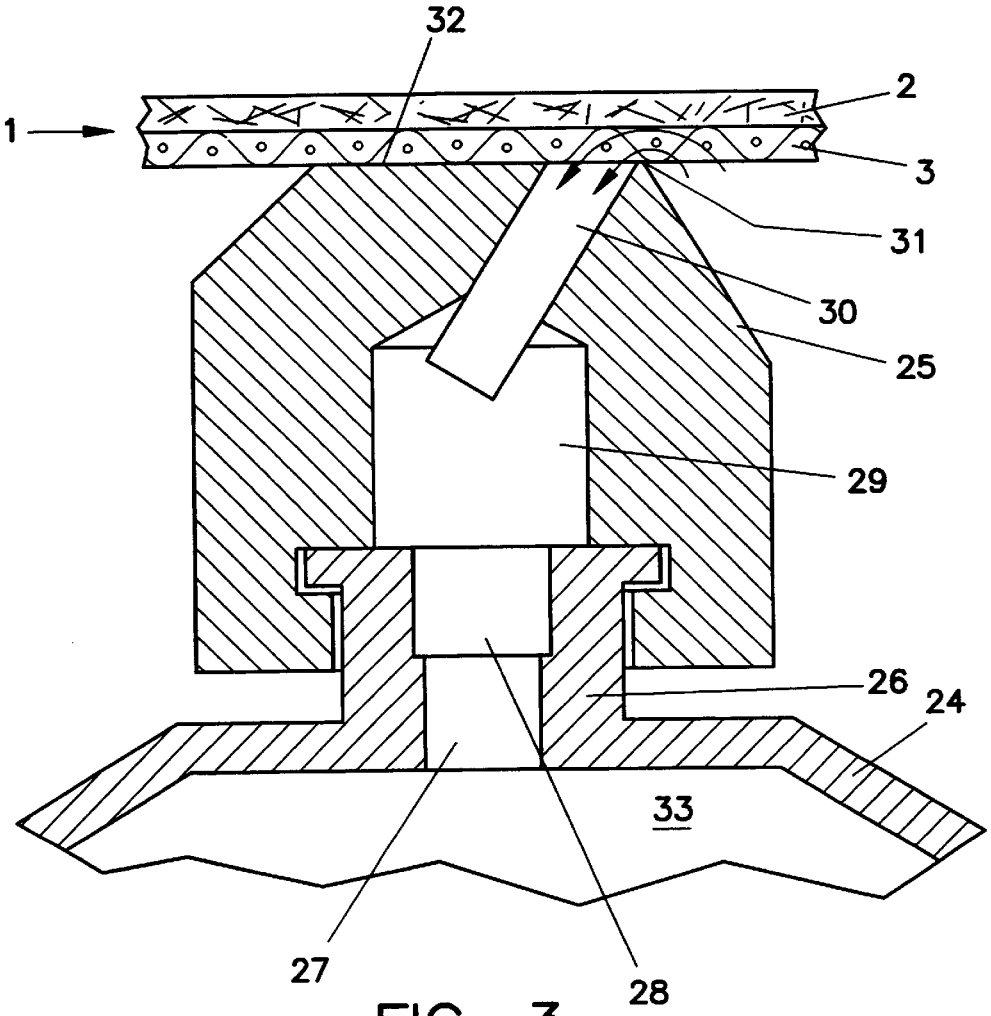
FIG. 3 is a cross-sectional view of another simplified embodiment of a felt purger.

FIG. 3 also shows a small horizontal segment 1 of a running felt loop with bat layer 3 and carrier layer 2 sliding over a nozzle block 25 from left to right or vice versa. The nozzle block 25 is keyed to T-bar 26 which is part of a suction or blow box 24. The interior 33 of box 24 is connected to slotted nozzle 30 via passages 27 and grooves 28 inside the T-bar and holes 29 in the nozzle block 25. The slot 30 is separated from the ambient atmosphere by a sharp-edged lip 31 to the right that may or may not touch the felt 1. To the left of the nozzle slot 30, the felt 1 may be supported by the face 32 of nozzle block 25. The nozzle block 25 extends in cross machine direction over the full width of the felt 1.

The flow of purging air, as indicated by arrows for the example of vacuum in conduit 24, is conducted over the edge 31, through the base layer 2, into slots 30, through holes 29, groove 28 and passages 27, and into the chamber 33.

Figure 4:
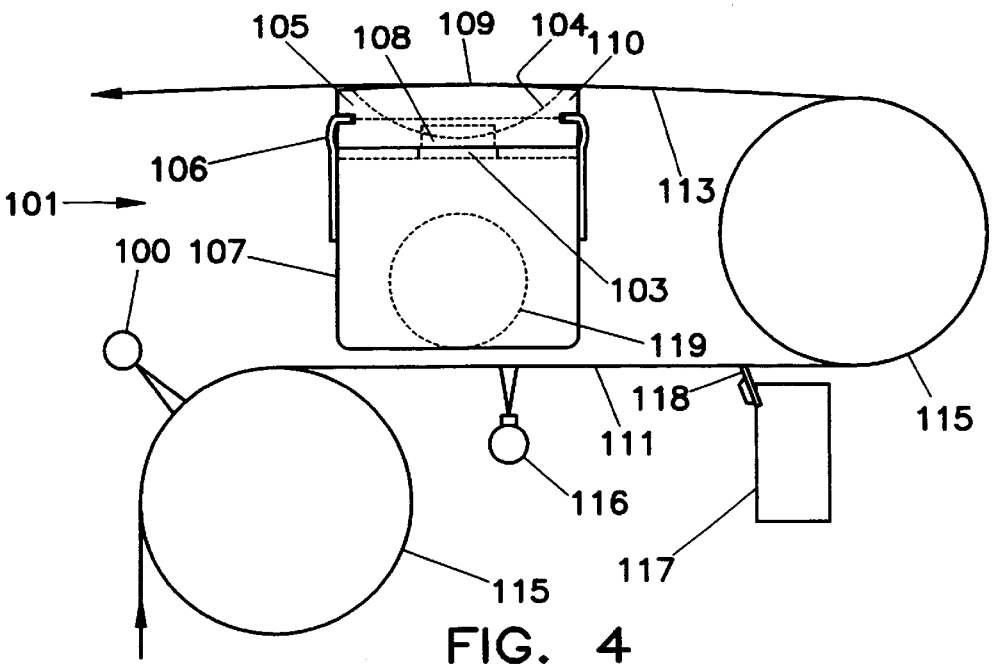
FIG. 4 is schematic, side view of one embodiment of a felt return run of a press section including the felt purger of FIGS. 5 to 7.

In FIG. 4, a felt 111 is guided in the direction of the arrows over felt rolls 115 to a felt purger 101 and over its supporting surface 109. An internal shower pipe 100 cleans or moistens the inside surface of the felt loop 111 and an external shower pipe 116 cleans and moistens the outside surface of the felt loop 111. A scraping blade 118 is fastened to cross machine beam 117 and removes surface contaminations from the felt 111.

The felt purger 101 is composed of a suction box 107 extending over the width of the machine to which a nozzle block 105 is fastened by clamping bars 106.

For purging water out of the carrier layer 113 of felt 111, the suction box 107 is connected to a vacuum source (blower or pump) via vacuum line 119. Air is drawn from the longitudinal air supply slots 110, through the carrier layer 113 of felt 111, into suction slots 104, through passages 108 and 103, and into suction box 107.

Figure 5:
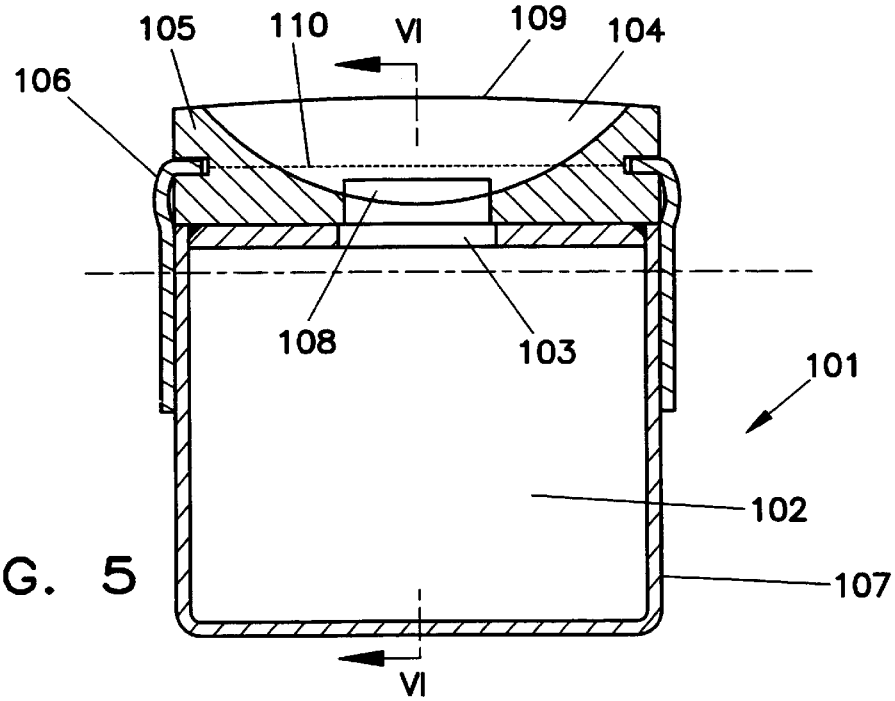
FIG. 5 is a cross-sectional view of yet another embodiment of a felt purger, with suction slots oriented in the felt running direction.
Figure 6:
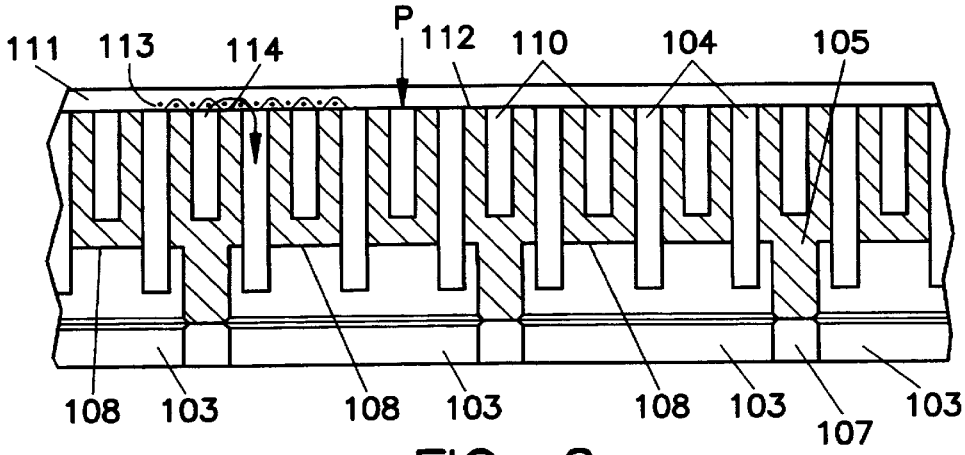
FIG. 6 is a longitudinal, sectional view of the felt purger of FIG. 5 along line VI—VI.
Figure 7:
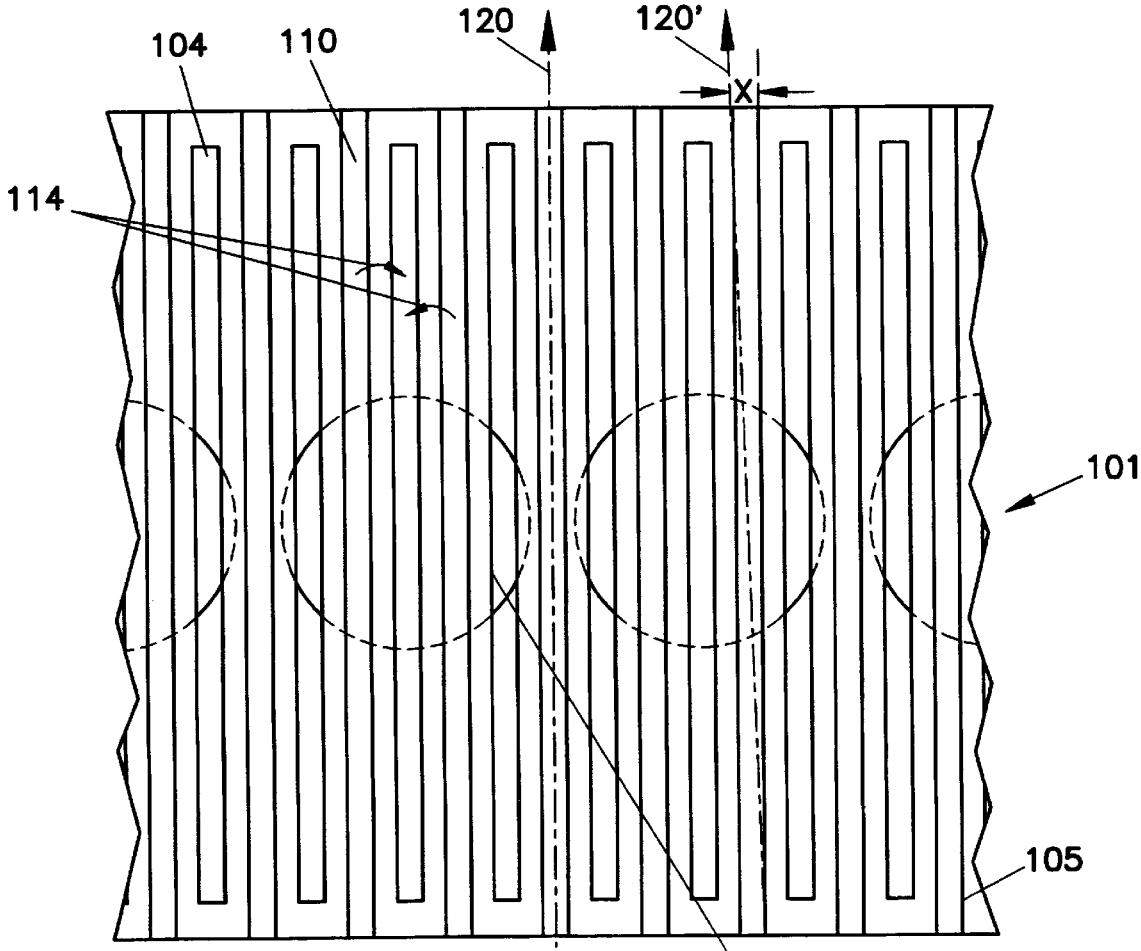
FIG. 7 is a top view of the gliding surface of the felt purger of FIGS. 5 and 6.

The felt purger 101 is more closely described in FIGS. 5, 6 and 7 using the same reference numbers of identification. FIG. 5 is only an enlarged cross-sectional view of the air purger 101 of FIG. 4. It is visible that the bores 108 extending from bores 103 terminate at a depth at which they intersect with suction slots 104 but do not meet the air supply slots 110. This relation is even more clearly visible in FIG. 6. Each bore 108 connects into several suction slots 104. The felt 111 has a coarse air and water permeable carrier layer 113 through which air is drawn from the air supply slots 110 past the partition bars 112 into the suction slots 104 as indicated by arrows 114.

Figure 8:
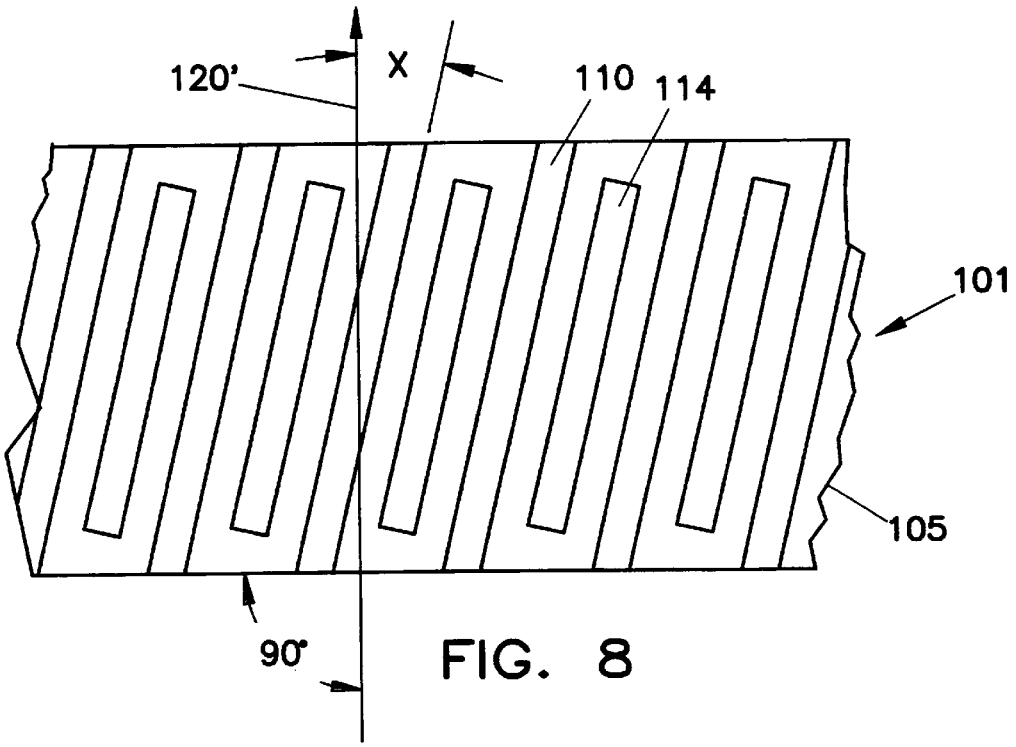
FIG. 8 is another embodiment of the slot pattern of FIG. 7.

This flow pattern is also shown in FIG. 7 in top view. For clarity's sake, the felt is not shown. If the felt purger 101 is fitted into the press section with its axis extending in cross machine direction, the air supply slots 110 and the suction slots 104 extends parallel to the felt running direction, indicated by arrow 120. By a rotation of the felt purger 101 about an axis substantially perpendicular to felt 111, the direction of felt run 120' is no longer parallel to the slots 104 and 110. The direction of felt run 120' forms an angle of inclination "X" with each of slots 104 and 110. With such an inclination, the dewatering by air purging through the carrier layer 113 of the felt 111 becomes more effective and more uniform across the width of the felt 111. The same effect can be achieved according to the alternative shown in FIG. 8. In this embodiment, the longitudinal axis of the felt purger 101 runs at right angles to the direction of felt travel 120' and only the longitudinal direction of the slots 104 and 110 is inclined by an angle "X" relative to the direction of felt travel 120'.

Figure 9:
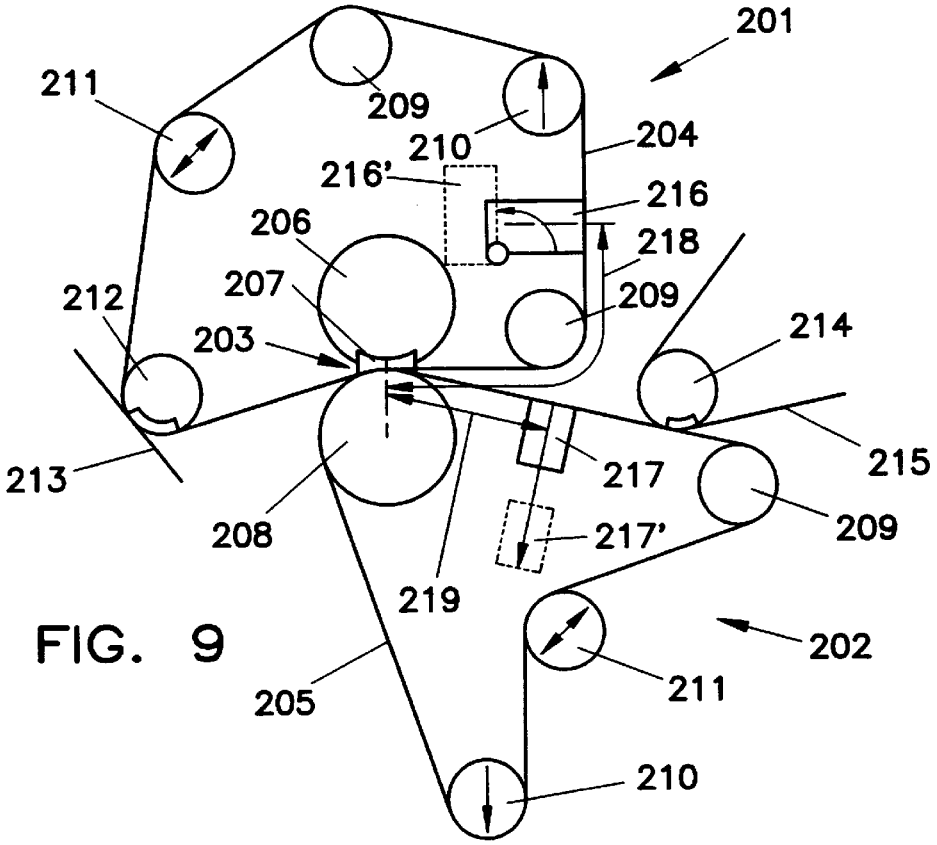
FIG. 9 is a schematic, side view of another embodiment of a press section including felt purgers applied to felts.

FIG. 9 is a simplified view, omitting the machine frames. A top felt run 201 with top felt 204 and a bottom felt run 202 with bottom felt 205 pass through the common press nip 203. The press nip 203 is formed between an upper press roll 206 which is characterized as a shoe press roll by press shoe 207, and a bottom press roll 208, the surface of which may contain grooves or blind drilled holes. The felts 204 and 205 are guided by felt rolls 209, stretch rolls 210 and felt guide rolls 211.

The top felt 204 is carried by a suction pickup roll 212 that transfers a paper web from a belt 213 to the top felt 204 which, in turn, conveys the web into the press nip 203. The paper web is carried away from the nip 203 by the bottom felt 205 and is transferred by suction roll 214 to belt 215. Within the loop of felt 204 there is a felt purger 216 which contacts the felt 204 in operation. Felt purger 216 can be rotated into position 216' for cleaning.

Inside the loop of the felt 205 there is a felt purger 217 contacting felt 205. For cleaning purposes it can be retracted into position 217'. The distances 218 and 219 of the felt purgers 216 and 217 from the press nip 203 are smaller than 25% of the lengths of the respective felts 204 and 205.

Figure 10:
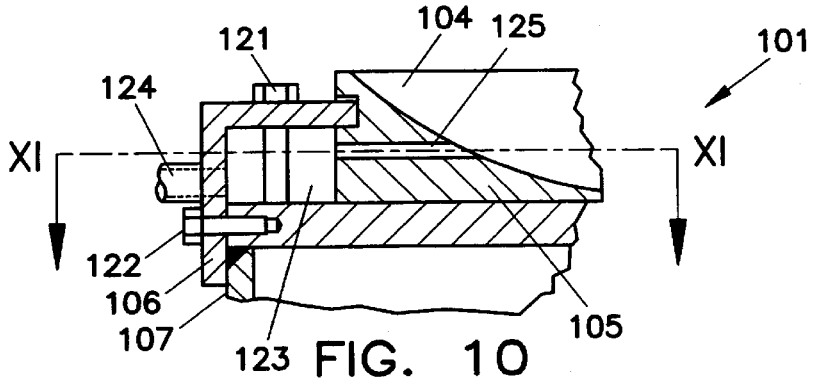
FIG. 10 is a fragmentary, side, cross-sectional view of a variation of the felt purger of FIG. 5.

In FIG. 10, a felt purger 101 is shown as in FIG. 5, including a nozzle block 105 and a suction box 107, connected by clamps 106. Clamp 106 is fastened to the suction box 107 by screws 121 and 122 and encloses, together with nozzle block 105 and suction box 107, a water chamber 123 that can be supplied with cleaning water through feed pipes 124. The water chamber 123 feeds cleaning water through cleaning nozzles 125 into the crescent-shaped suction slots 104 in order to flush off solid matter that may have accumulated there in the course of time.

Figure 11:
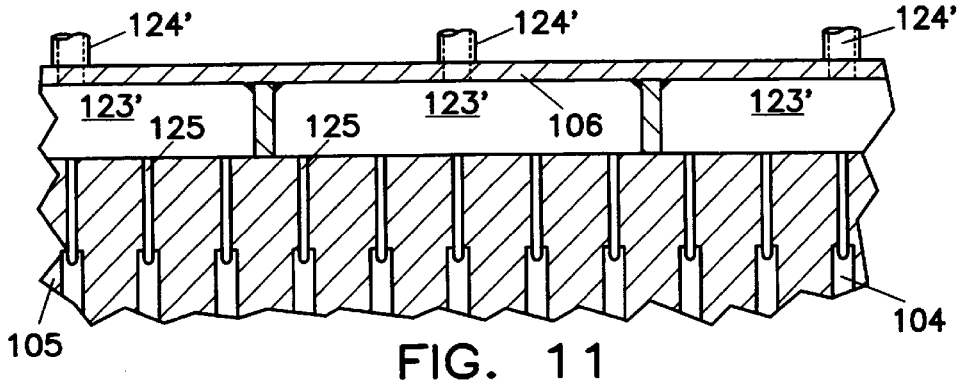
FIG. 11 is a top, sectional view of the felt purger of FIG. 10 along line XI—XI.

In order to avoid an excessive flow of water during the cleaning cycle, it is of advantage to sub-divide the water chamber 123 as shown in FIG. 11 into a number of sections 123' that are sequentially fed with cleaning water through feeding pipes 124'. If there are 10 sections 123' provided across the felt width and only one section 123' is activated at a time, the necessary flow rate of cleaning water is reduced to 1/10 of that necessary with a continuous chamber 123.

Figure 12:
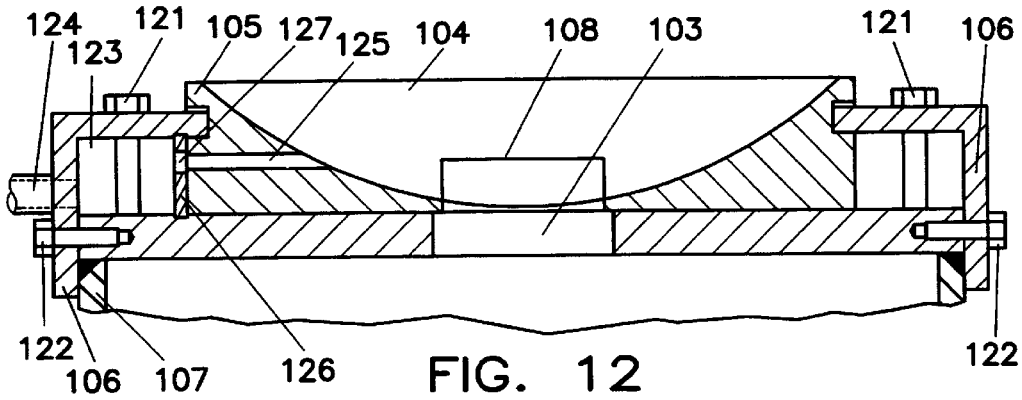
FIG. 12 is a cross-sectional, side view of a modification of the felt purger of FIG. 10 with sliding bar type cleaning water distribution.

FIG. 12 is another modification to FIGS. 5 and 10 with a suction box 107 to which a nozzle block 105 is fastened by use of clamping bars 106 and screws 121 and 122. At least one clamping bar 106 (shown at left) together with nozzle block 105 and suction box 107 encloses a water chamber 123 with water supply lines 124. Cleaning nozzles 125 lead from the water chamber 123 into the suction slots 104. In front of the entrances of the nozzles 125 there is a sliding bar 126 with ports 127 which can be brought into line with the entrances of the nozzles 125 by moving the bar 126 in a horizontal or cross machine direction. The spacing of the ports 127 is arranged in a way that opens and closes the entrances of the nozzles 125 when the bar 126 is oscillated in cross machine direction. Thus, all nozzles 125 are sequentially supplied with cleaning water.

Figure 13:
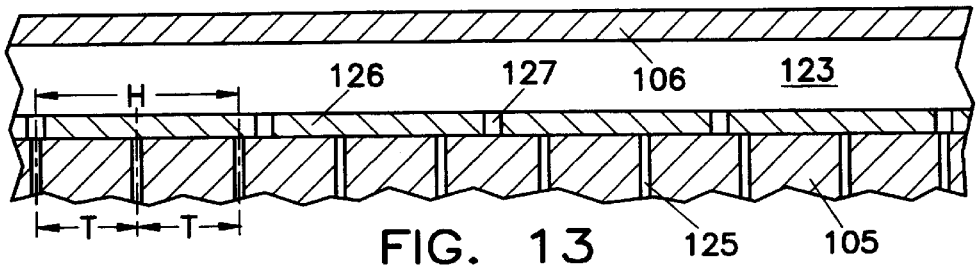
FIG. 13 is a top, sectional view of the sliding bar of FIG. 12.

In FIG. 13, one example of the placing of the ports 127 in the bar 126 is shown. By use of this spacing, all suction slots 104 can be cleaned with an equal amount of water. If the spacing of the ports 127 is chosen to be 9/4 of the spacing "T" of the cleaning nozzles 125, only every ninth cleaning nozzle 125 is simultaneously supplied with water. If the stroke "H" of the oscillating bar 126 is twice the distance "T" of neighboring nozzles 125, the maximum water flow is 1/9 of that of the arrangement shown in FIG. 10. This flow is substantially equally distributed to all nozzles 125. Thus, cleaning nozzles 125 are sequentially operable and each cleaning nozzle 125 is discontinuously operable.

The flow of water during a cleaning period can be reduced even further by increasing the distances between the ports 127 in bar 126.

If only every n-th nozzle 125 is fed water, the width of the port 127 is chosen T/4, and the distance from port 127 to port 127 is chosen xT+¼ T, then the following relations exist: n=4x+1 and stroke H=xT.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In a paper machine, an apparatus for purging water out of a felt loop, the felt loop including a travel direction, a total length, an inner surface and a carrier layer having a plurality of cavities, said apparatus comprising:

means for directing a stream of a purging gas toward the inner surface of the felt loop to thereby loosen the water therefrom, said directing means including a plurality of purging nozzles configured for contacting the inner surface of the felt loop; and a water removal device positioned adjacent to the inner surface of the felt loop, said water removal device being configured for capturing the water loosened from the inner surface of the felt loop, said water removal device including a nozzle block having a plurality of suction slots configured for engaging the inner surface of the felt loop, said purging nozzles and said suction slots being arranged alternatingly with one another and substantially parallel to the direction of felt travel.

2. The apparatus of claim 1, further comprising a cleaning shower positioned adjacent to the inner surface of the felt loop, said cleaning shower being disposed before said directing means and said water removal device relative to the travel direction of the felt loop.

3. The apparatus of claim 1, further comprising a press section including a press nip associated with the felt loop, said water removal device being disposed after said press nip relative to the travel direction of the felt loop, said water removal device being disposed a distance from said press nip, said distance being not greater than 25% of the total length of the felt loop.

4. The apparatus of claim 1, wherein said purging gas comprises air.

5. The apparatus of claim 1, each said purging nozzle containing a purging pressure of one of positive pressure and negative pressure, said purging pressure being sufficient for only loosening water from the felt loop.

6. The apparatus of claim 1, wherein each said purging nozzle comprises an air supply slot and wherein a longitudinal direction of each said air supply slot and a longitudinal direction of each said suction slot is oriented at an angle approximately between 0° and 10° relative to the travel direction of the felt loop.

7. The apparatus of claim 1, further comprising a suction box fastened to said nozzle block.

8. The apparatus of claim 7, wherein said suction box is one of rotatable and retractable such that said suction box is accessible for cleaning.

9. The apparatus of claim 1, wherein said nozzle block includes a plurality of cleaning nozzles configured for flushing said suction slots.

10. The apparatus of claim 9, wherein each said suction slot is fitted with at least one said cleaning nozzle.

11. The apparatus of claim 10, wherein said cleaning nozzles are sequentially operable, each said cleaning nozzle being discontinuously operable.

12. In a paper machine, a nozzle block for purging water out of a felt loop, the felt loop including a felt travel direction and having an inner surface and a width, said nozzle block comprising:

a plurality of purging nozzles aligned parallel to the felt travel direction and configured for contacting the inner surface of the felt loop, said purging nozzles further being configured for creating a flow of a purging gas at the inner surface of the felt loop to thereby loosen the water therefrom; and a plurality of suction slots aligned parallel to the felt travel direction and being configured for removing the water loosened from the inner surface of the felt loop, said plurality of suction slots being alternatingly arranged with said plurality of purging nozzles.

13. In a paper machine, an apparatus for purging water out of a felt loop, the felt loop including a travel direction, a total length, an inner surface and a carrier layer having a plurality of cavities, said apparatus comprising:

means for directing a stream of a purging gas toward the inner surface of the felt loop to thereby loosen the water therefrom, said directing means including a plurality of purging nozzles configured for contacting the inner surface of the felt loop; and a water removal device positioned adjacent to the inner surface of the felt loop, said water removal device being configured for capturing the water loosened from the inner surface of the felt loop, said water removal device including a nozzle block having a plurality of suction slots configured for engaging the inner surface of the felt loop, said purging nozzles and said suction slots being arranged alternatingly with one another and oriented substantially parallel to the direction of felt travel, said nozzle block including a plurality of lips, each said lip being disposed between a corresponding said air supply slot and a corresponding said suction slot, each said lip having a width approximately between 2 mm and 10 mm.

14. The apparatus of claim 13, wherein each said width of each said lip is approximately between 4 mm and 10 mm.

* * * * *